US008336136B1

(12) United States Patent
Lantos

(10) Patent No.: US 8,336,136 B1
(45) Date of Patent: Dec. 25, 2012

(54) PANEL ASSEMBLY FOR A PARTIAL DROP-SIDE CRIB

(76) Inventor: Susanne Debora Lantos, Ottawa (CA)

( * ) Notice: Subject to any disclaimer, the term of this patent is extended or adjusted under 35 U.S.C. 154(b) by 0 days.

(21) Appl. No.: 13/291,590

(22) Filed: Nov. 8, 2011

Related U.S. Application Data

(60) Provisional application No. 61/411,659, filed on Nov. 9, 2010.

(51) Int. Cl.
*A47D 7/02* (2006.01)

(52) U.S. Cl. ..... 5/100; 5/93.1

(58) Field of Classification Search ..... 5/93.1, 5/100, 424–425, 428
See application file for complete search history.

(56) References Cited

U.S. PATENT DOCUMENTS

| | | | | |
|---|---|---|---|---|
| 1,695,571 | A * | 12/1928 | Baxter | 5/100 |
| 4,359,792 | A | 11/1982 | Dale | |
| 4,535,493 | A | 8/1985 | Guillot | |
| 4,703,524 | A * | 11/1987 | Brunner et al. | 5/93.1 |
| 4,768,243 | A | 9/1988 | Waples | |
| 4,924,539 | A | 5/1990 | Benoit | |
| 6,505,360 | B2 | 1/2003 | Guillot | |
| 6,704,951 | B2 | 3/2004 | Hofer et al. | |
| 7,062,806 | B2 | 6/2006 | Merlin | |
| 7,415,740 | B1 | 8/2008 | Kemper | |
| 7,752,689 | B1 * | 7/2010 | Shamie et al. | 5/100 |

FOREIGN PATENT DOCUMENTS

| | | |
|---|---|---|
| CA | 1245008 | 11/1988 |
| CA | 2034366 | 4/1992 |
| CA | 2302066 | 10/2000 |

* cited by examiner

*Primary Examiner* — Fredrick Conley
(74) *Attorney, Agent, or Firm* — Freedman & Associates

(57) ABSTRACT

A panel assembly for installation onto a standard crib having a first and second rail and a first moveable panel and a second fixed panel within the first and second side rail. The panel assembly can also be directly incorporated within a standard crib without the need to install the panel assembly.

7 Claims, 24 Drawing Sheets

PANEL ASSEMBLY FOR A PARTIAL DROP-SIDE CRIB

CROSS-REFERENCE TO RELATED APPLICATIONS

This application claims priority to U.S. Provisional Patent Application No. 61/411,659 filed Nov. 9, 2010. The instant application claims the benefit of all the listed applications, which are hereby incorporated by reference in their entireties.

FIELD OF THE INVENTION

The invention relates to a panel assembly and, more specifically, a panel assembly for use on cribs.

BACKGROUND OF THE INVENTION

Drop-side cribs have been used for many years to facilitate lifting a child in and out of a crib. Some previous attempts at addressing the need for a crib that has a side that may be lowered include U.S. Pat. No. 6,704,951, which describes a drop-side crib whereby the lowering side is released by double-action latch mechanisms that lie across the top of the side. The drop-side upper railing has an upper bar fixedly secured upon a lower bar; the lower surface of the upper bar opens to a longitudinally-extending groove slidably receiving rods of the two latches. Another U.S. Pat. No. 4,924,539 describes a different drop-side crib mechanism.

Some have used mesh as an alternative to the bars of a traditional crib, which prevents the child from passing his or her limbs through. An example is U.S. Pat. No. 4,359,792, which discloses a crib with mesh walls that replace the multiplicity of rigid vertical bars, as well as a canopy. This patent describes a different drop-side mechanism whereby the entire side may be lowered. U.S. Pat. No. 7,062,806 describes a bedding structure with a flexible door made from mesh that may be slid around the structure on tracks to close and limit ingress or egress.

Other examples in the art include Canadian Patent No. 2302066, which describes concealed hardware for raising and lowering of the crib side, permitting construction with no projecting or exposed parts. Canadian Patent No. 2034366 describes a crib with drop-side that also features a horizontal position. In Canadian Patent No. 1245008 a double-action drop-side lock is disclosed, comprising a guide member connected to the crib or to the drop-side in a vertically oriented position. A slide member (for raising and lowering the drop-side) is slidably mounted to the guide member between two positions.

U.S. Pat. No. 6,505,360 describes a crib with a drop-side and the guiding and locking mechanism therefor with use of both upper and lower guides. U.S. Pat. No. 4,535,493 describes a crib drop-side latch, wherein the side must be lifted slightly for the latch to be actuated, and U.S. Pat. No. 4,768,243 describes a latch for a drop-side crib with a different actuator and two retractable pins holding the drop-side in place.

In conventional drop-side cribs, the entire side panel is first moved up, then out, then down on opening (to down position), then this action sequence is reversed (up, in, down) on closing (to up position). However, this type of drop-side crib has recently come under scrutiny as a result of injuries to—and deaths of—children, mostly owing to the drop-side panel coming loose (through either improper installation or defects causing detachment of the drop-side), causing the child to either slide into and get stuck between the mattress and the loose panel side, or to become wedged between the top of the drop-side and the crib post. The above prior art does not address a safe means of drop-side, such that injuries to children may be avoided.

There is a need in the art for a safe drop-side mechanism on a crib such that there is no possibility of harm to the child within the crib. While this safe mechanism may be built into a crib it is also useful as a panel assembly that can be used to convert an existing crib to a safe drop-side mechanism.

SUMMARY OF THE INVENTION

The present invention provides a panel assembly for cribs which comprises a first and second rail. The panel assembly also has a first moveable panel and a second fixed panel within the first and second side rail. The panel assembly can be installed to a standard crib. The present invention also provides a crib having a first and second crib post. A first and second side rail are incorporated within the crib posts. The crib also has a first moveable panel and a second fixed panel to the first and second side rail. The first moveable panel is positioned within the first and second side rails.

BRIEF DESCRIPTION OF THE DRAWINGS

The following figures serve to illustrate various embodiments of features of the invention. These figures are illustrative and are not intended to be limiting.

DETAILED DESCRIPTION OF THE DRAWINGS

The following embodiments are merely illustrative and are not intended to be limiting. It will be appreciated that various modifications and/or alterations to the embodiments described herein may be made without departing from the invention and any modifications and/or alterations are within the scope of the contemplated invention.

Figure 1:
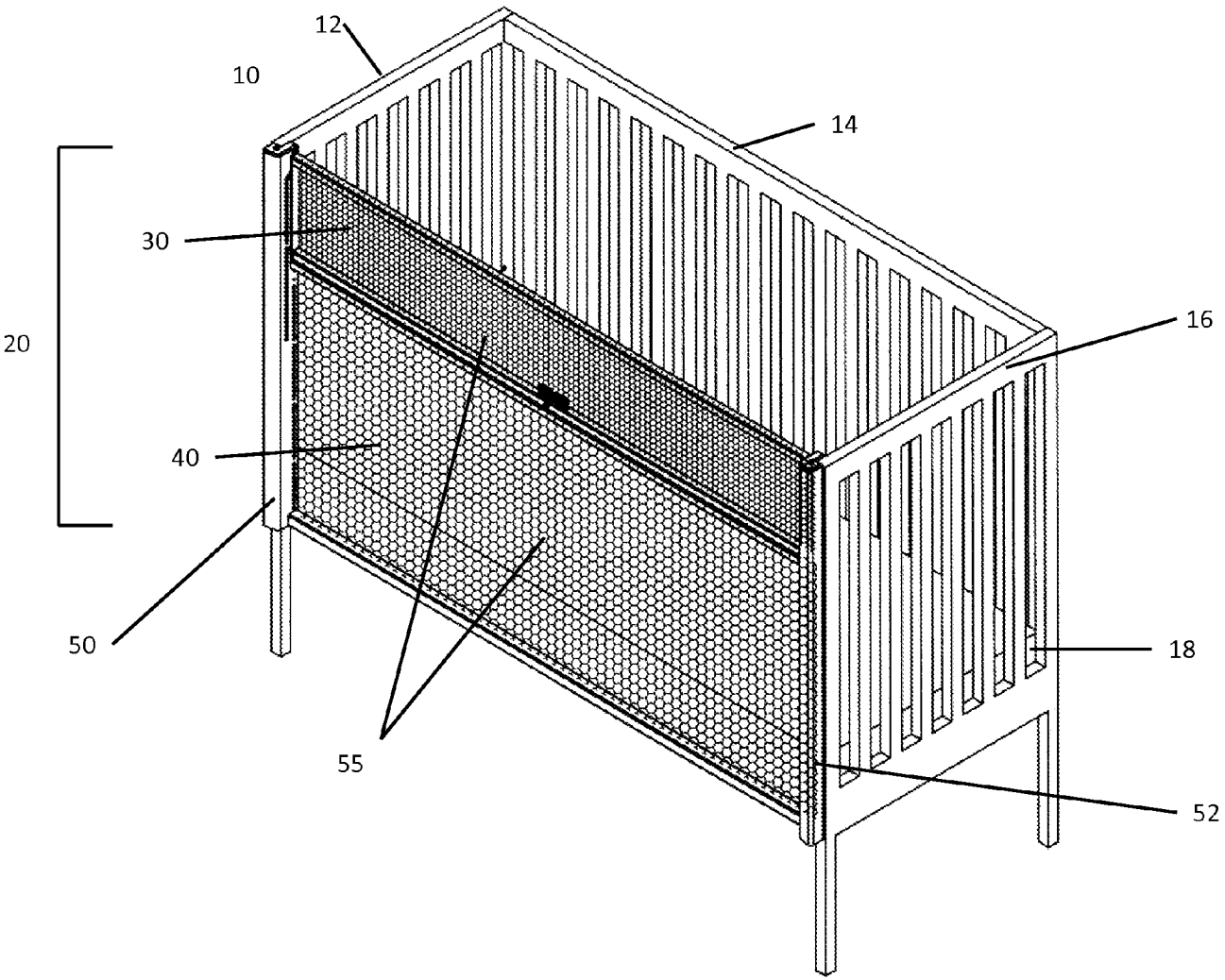
FIG. 1 is a perspective view illustrative of one embodiment of a panel assembly of the present invention installed on a standard crib.

With reference to FIG. 1, a panel assembly 20 is shown that may either be installed into an existing crib by replacing one of the crib walls, or the panel assembly 20 may be incorporated into a new crib. FIG. 1 shows one embodiment installed on a crib 10. The crib 10 has three fixed sides 12, 14 and 16 and a mattress support 18 as would be found in a standard crib and a panel assembly 20, comprising two panels, a first moveable panel 30 and a second stationary panel 40, which are positioned between a first side rail 50 and a second side rail 52. In this embodiment, both the first and second panels 30, 40 are covered with mesh material 55 and panels 30 and 40 may be composed of either a metal, wooden or plastic frame. In other embodiments, the second panel 40 may be solid or be composed of a grille or lattice, for example. The second panel 40 is mounted and fastened between the first and second side rails 50 and 52 and is stationary and therefore cannot be moved without being unfastened. While the lower second panel 40 may be composed of various materials in other embodiments, it is the mesh-filled frame in the first panel 30 that allows for an added measure of safety by preventing the entry of the child's limbs into the panel. It also addresses problems, such as where a child attempts to use the panel as a toe hold, by reducing the ability of a child to climb. In addition, the use of mesh 55 allows for constant, unobstructed visual access to the occupant in the crib by a caregiver. The holes in the mesh 55 may be larger or smaller in size, or may optionally include designs printed on the mesh 55, without departing from the scope of the invention. The mesh 55 may also be replaced by other material such as transparent or translucent plastic to address problems of entry, visual access, and toe holds.

Figure 2B:
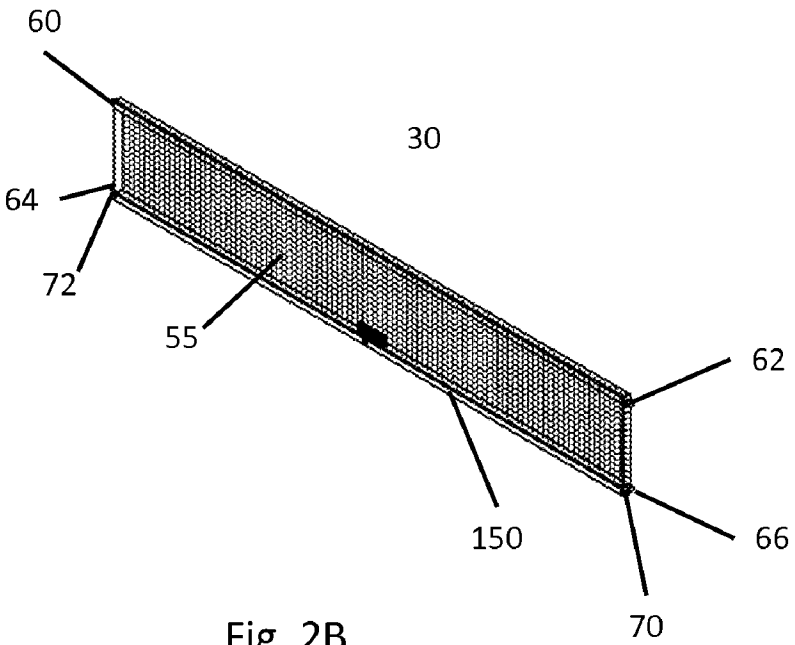
FIGS. 2A and 2B show a perspective view illustrative of one embodiment of a disassembled first and second panel as found in one embodiment of a panel assembly.
Figure 2A:
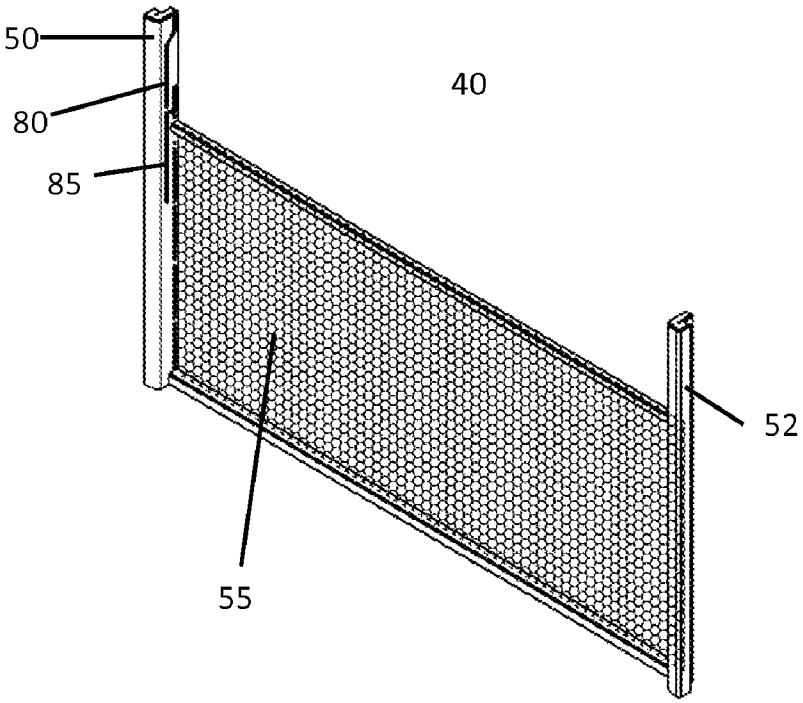

With reference to FIGS. 2A and 2B, the first and second panels 30 and 40 of the panel assembly are shown disassembled and not installed on a crib. The first panel 30 has an upper projection 60 and a lower projection 64 adapted to be constrained and displaceable within the upper and lower tracks 80, 85 in the side rail 50. This allows for the top first panel 30 to be moved within the tracks 80, 85 between a closed position and an open position. A worker skilled in the relevant art would be familiar with the placement of the upper projections 60 and 62 and the lower projections 64 and 66 within respective tracks as defined by the upper and lower tracks 80, 85 in side rails 50 as well as corresponding tracks (not shown) in the side rail 52. The second panel 40 has mesh material 55 similar to first panel 30.

With further reference to FIG. 2B, first panel 30 also has first and second spring plungers 72 and 70 which are positioned underneath lower projections 64 and 66. These spring plungers enable the first panel 30 to be secured into the first and second side rails 50 and 52 in either a closed or open position as further described below. The first panel 30 also has a hollow tube 150 which allows for the operation of a locking mechanism further described below.

Figure 3:
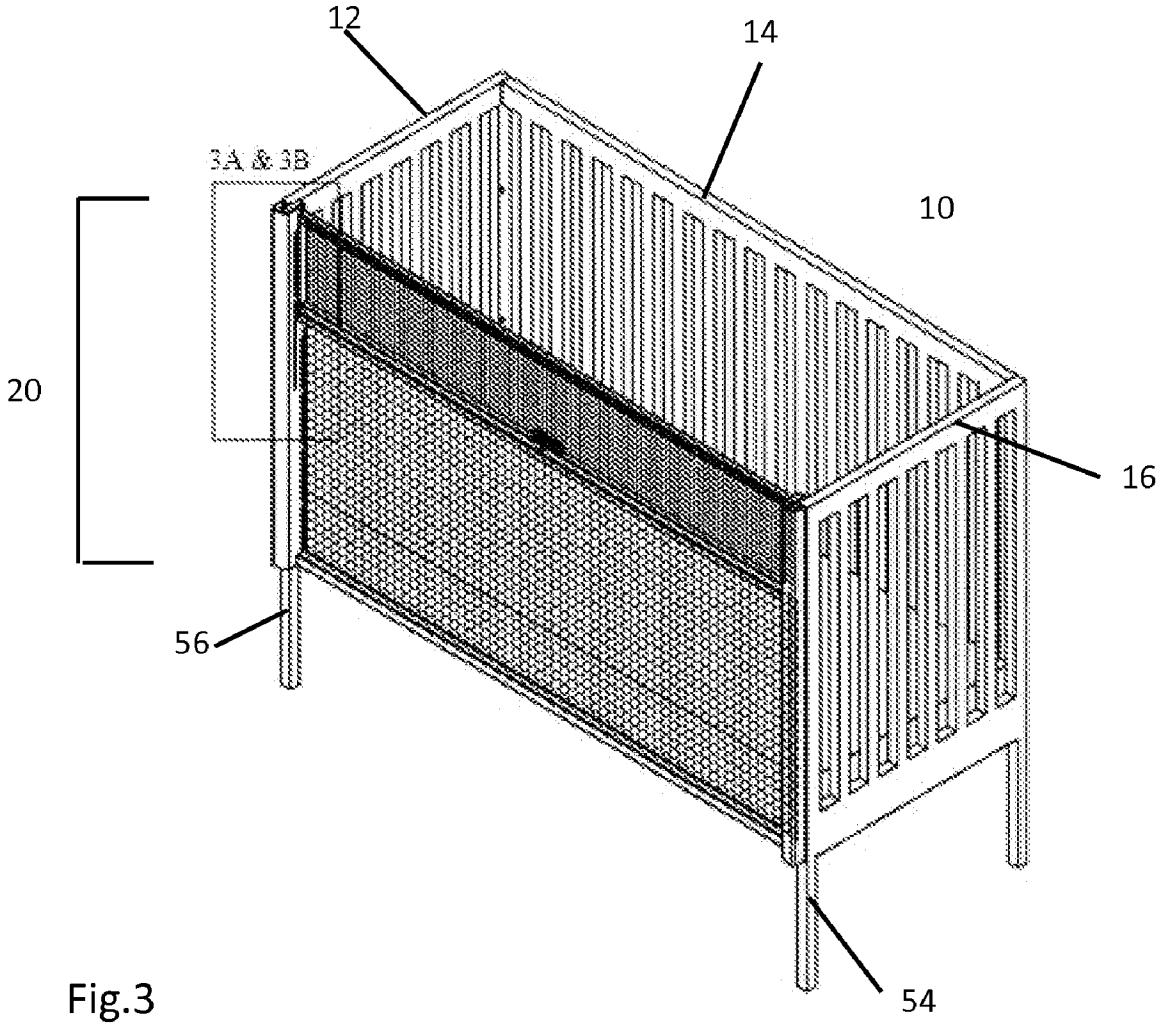
FIG. 3 is a perspective view illustrative of one embodiment of a panel assembly in a closed position installed on a standard crib design.
Figure 3A:
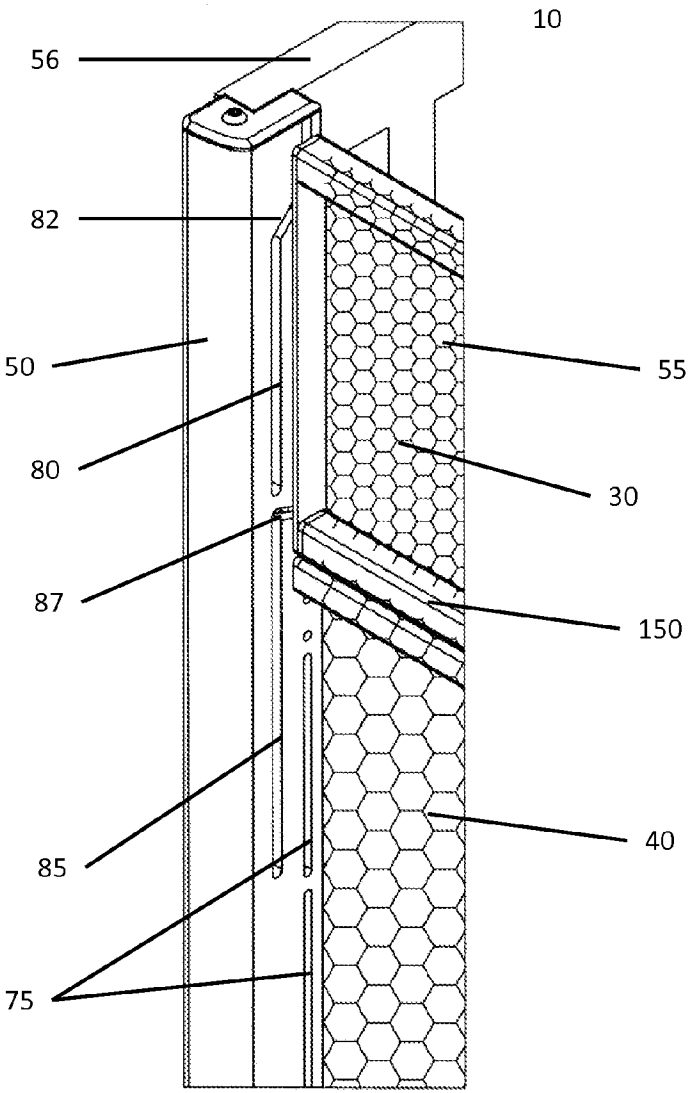
FIG. 3A is a detailed view illustrative of one embodiment of a panel assembly in a closed position with respect to a first side rail.
Figure 3B:
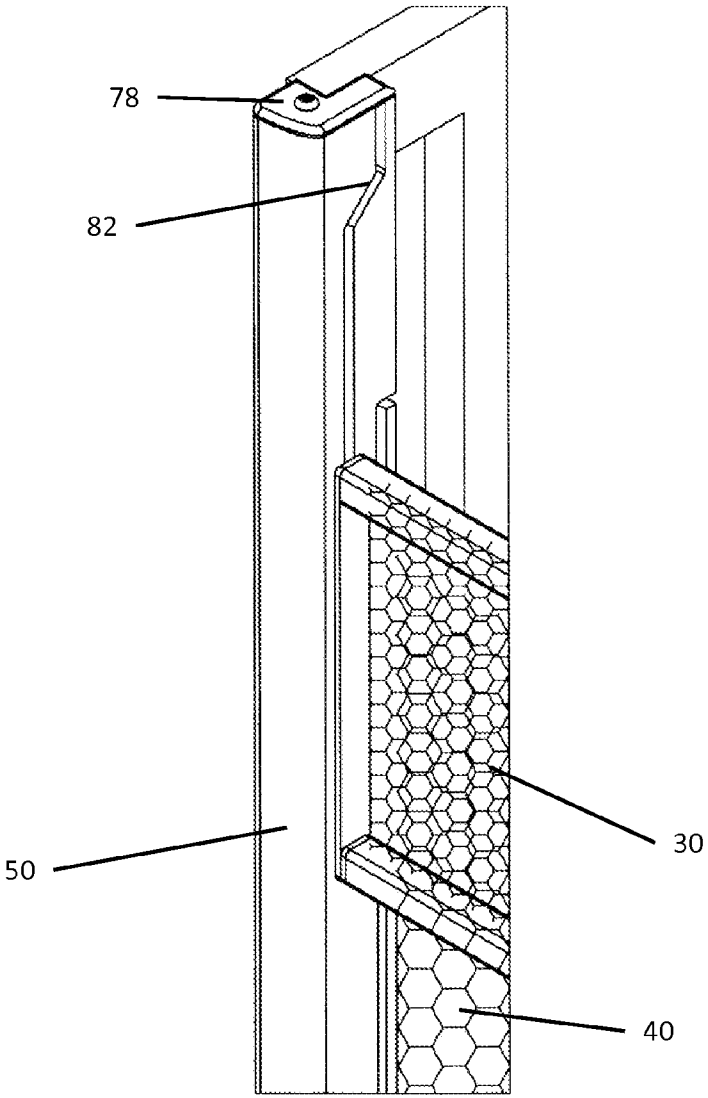
FIG. 3B is a detailed view illustrative of one embodiment of a panel assembly in an open position with respect to a first side rail.

With reference to FIGS. 3, 3A and 3B, the panel assembly 20 is mounted onto a standard size crib 10 by the addition of a first and a second side rail 50 and 52 (shown in FIG. 2A) mounted on two adjacent crib posts 54 and 56 as shown in FIG. 3. The panel assembly 20 may also be incorporated into a new crib construction, wherein the first and second side rails 50, 52 are manufactured within the crib posts 54 and 56 and cannot be removed. In one embodiment and as shown in FIGS. 3, 3A and 3B, the panel assembly 20 is retrofitted to an existing crib 10, wherein the first and second side rails 50 and 52 are fastened into the existing crib posts 54 and 56 in several locations, using two existing apertures (not shown) in the crib posts 54 and 56. If apertures do not exist, these may be added for example by drilling into crib posts 54, 56. First and second side rails 50, 52 may then be secured to crib posts 54, 56 by fastening means, for example screws or bolts, in addition to other means known in the art. With specific reference to FIG. 3A, to accommodate various locations of existing apertures (not shown) in the crib post 56 for fastening the first side rail 50, in one embodiment a number of mounting slots 75 are located along the inside of the first side rail 50. These mounting slots may optionally be integrated into the second side rail 52 as well.

In one embodiment and with further reference to FIG. 3A, the first side rail 50 has a set of tracks, including an upper track 80 and a lower track 85, for guiding the motion of the first panel 30. The tracks as defined under side rail 50 are mirror images of the tracks found on side rail 52 (shown in FIG. 2A). The upper track 80 has a vertical portion, with an inclined portion 82 inclined towards the interior of the crib 10 near the top of the vertical portion of the upper track 80. The lower track 85 also has a vertical portion, with a declined portion 87 declined towards the interior of the crib 10 near the top of the vertical portion of the lower track 85. With further specific reference to FIG. 3A, the first panel 30 is positioned in a closed position whereas as in FIG. 3B, the first panel 30 is positioned in an open position having been lowered through the guidance of upper and lower tracks 80 and 85.

With reference to FIGS. 2A, 2B, 3B and 4B, the first panel 30 can be removed or installed into the first and second side rails 50 and 52. The first panel 30 is installed within the first and second side rails 50 and 52 by placing the lower projection 64 (shown in FIG. 2A) into the lower track 85 and the upper projection 60 (shown in FIG. 2A) is positioned within the upper track 80 through an opening (not shown) at the top of the side rail 50. Once the upper projection 60 has been inserted into the upper track 80, a cover 78 is secured to the top end of the first side rail 50 to ensure that the first panel 30 cannot be removed from within the side rails. The lower projection 64 of the first panel 30 is positioned within the lower tracks 85 by way of an entry point 90 along the inside of the side rail 50 which has been secured to the post 56. Once the lower projection 64 has been positioned within the lower track 85 the entry point 90 may be sealed with a plug to prevent the lower projection 64 from leaving the track 85. A worker skilled in the relevant art would be familiar with the corresponding opening and entry point in the upper and lower tracks in side rail 52 allowing the installation or removal of the first panel 30.

Figure 5:
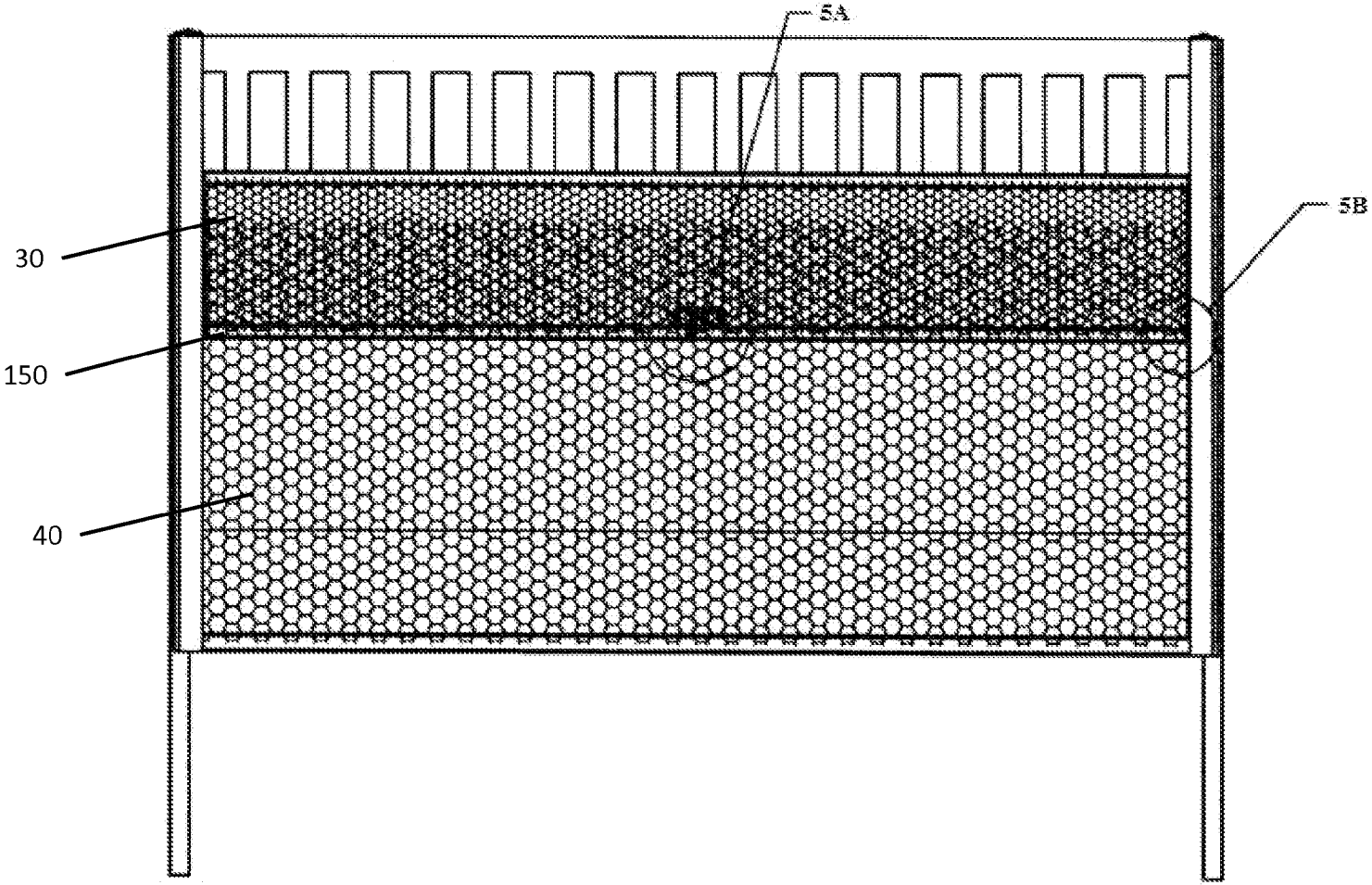
FIG. 5 is a front view illustrative of one embodiment of a panel assembly.
Figure 5A:
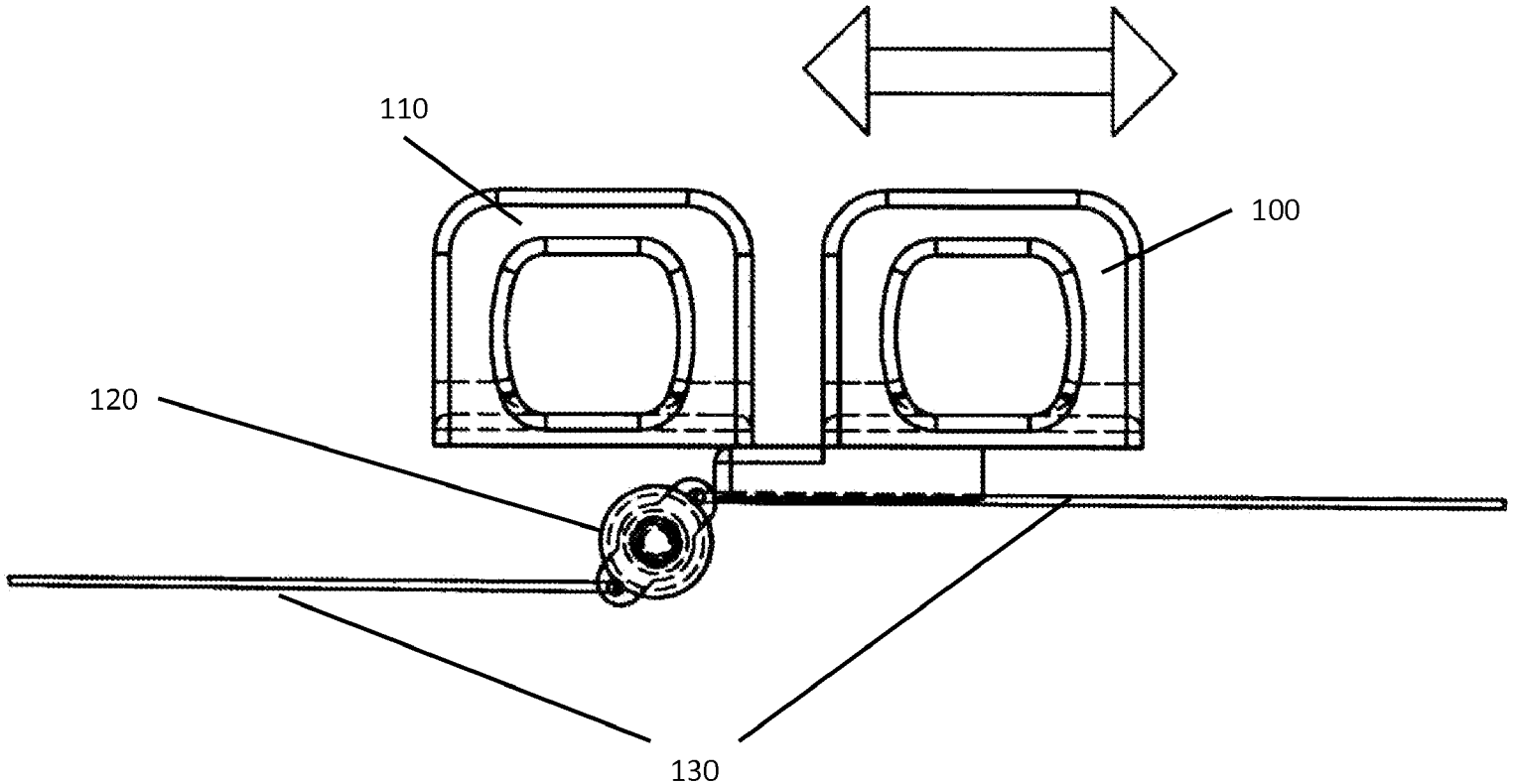
FIG. 5A is a top view illustrative of one embodiment of a locking mechanism with locking handles and cables.
Figure 5B:
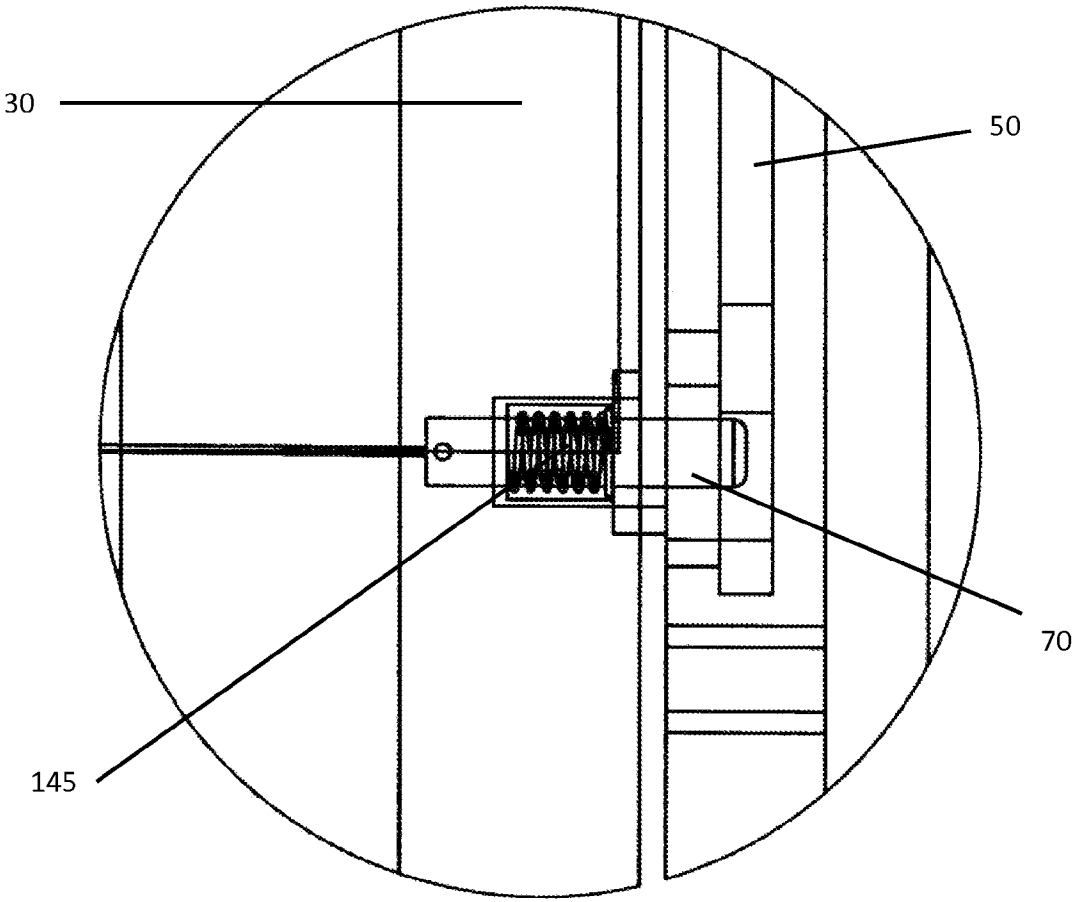
FIG. 5B is a cross-sectional view illustrative of one embodiment of a spring plunger in a first panel.

With reference to FIGS. 5, 5A and 5B, the first panel 30 is shown in an open position and locked into position through a locking mechanism further described with reference to FIG. 5A. The first panel 30 comprises a hollow tube 150 accommodating and allowing for the operation of the locking mechanism. With further reference to FIG. 5A, the locking mechanism has a set of handles, one stationary handle 110 and one moveable handle 100. When pulled towards each other, the handles 100, 110 rotate a pin 120 located within the hollow tube 150 at the bottom of the first panel 30. The rotating pin 120 pulls a set of cables 130, also located within the hollow tube 150, each cable being connected to first and second spring plungers 72 and 70 (not shown), having a spring 145. The first and second spring plungers 72 and 70 which secure the first panel 30 to the side rails 50 and 52 are then pulled inward by cables 130, so as to be flush with the side of the first panel 30 and permit the movement of the panel from a closed to an open position. It will be appreciated that any locking mechanism may be used to lock the first panel 30 in either of the open or closed position without departing from the contemplated invention.

Figure 4B:
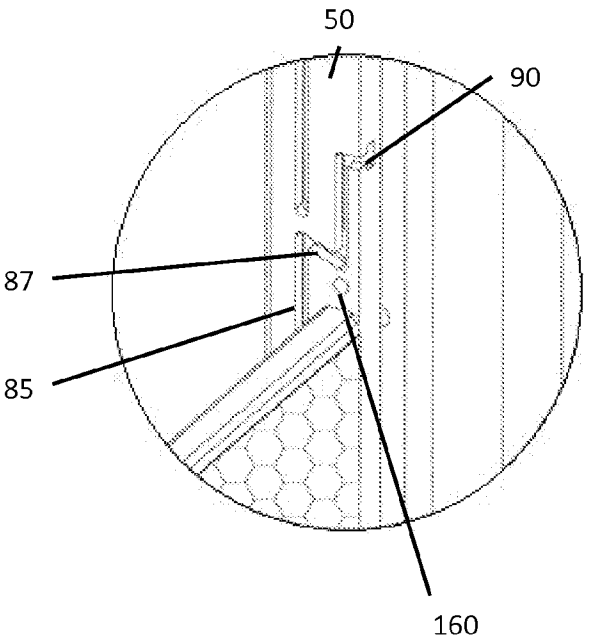
FIGS. 4A and 4B are perspective and detailed views, respectfully, illustrative of one embodiment of lower track entry points for installing an embodiment of a first panel in a panel assembly.

With regard to the operation of the panel assembly 20, the first panel 30 is moveable between an open position, where the first panel 30 is lowered and the removal of the child is facilitated, and a closed position, where the first panel 30 is raised and the child is safe within the crib. In the closed position as shown in FIGS. 3 and 3A, the upper projection 60 (not shown) is at the top of the inclined portion of the upper track 80, and the first spring plunger 72 is within locking apertures 160 as shown in FIG. 4B. Once the first spring plunger 72 is locked within the locking aperture 160, the first panel 30 will remain immobile so long as the two handles 100 and 110 remain inactivated. A worker skilled in the relevant art would be familiar with similar tracks as described for upper and lower tracks 80, 85 to be incorporated into side rail 52 for positioning upper projection 62 and second spring plunger 70 of first side panel 30.

Figure 4A:
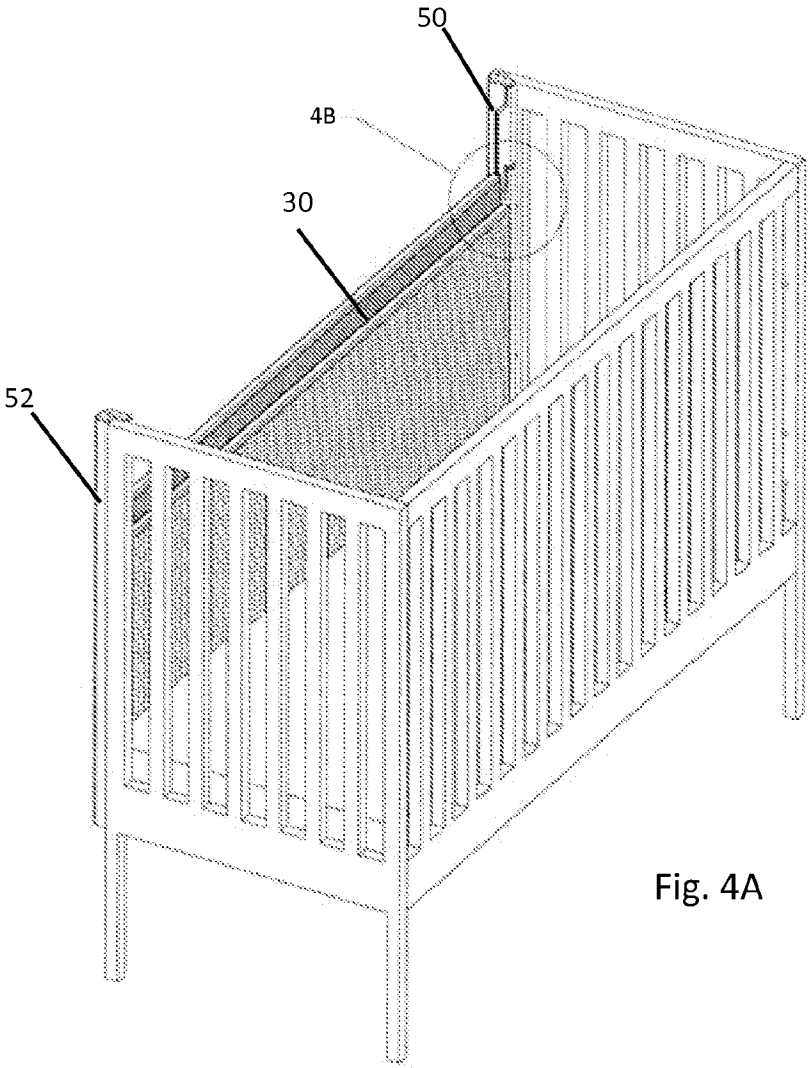

FIGS. 3B and 4A show the panel assembly 20 in an open position, which occurs when the upper projection 60 is at the bottom of the vertical portion of the upper track 80 and the lower projection 64 is at the bottom of the lower track 85. As a safety measure and to prevent inadvertent movement of the panel 30, the first and second spring plungers 72 and 70 (not shown), if not first retracted, prevent the descent of the lower projections 64 and 66 within the track. As an added safety measure, the lower projections 64 and 66 must then be slid up the decline portion 87 into the vertical portion of the track 85 before the upper panel 30 can be moved.

To move the top first panel 30 from a closed position to an open position, the handles of the locking mechanism 100 & 110 are clenched together and, while maintaining the clenched position of the locking mechanism handles 100, 110 the panel 30 is slid along the tracks 80, 85 of the side rail 50 outwards and then downwards. At any point, if the locking mechanism handles 100 & 110 are released, the first and second spring plungers 72, 70 are released, and movement of the panel 30 is prevented. To continue, the handles 100, 110 must again be compressed and the panel 30 is guided along the tracks 80, 85 of side rail 50. To reverse the motion and return the panel 30 to its upright position, the handles 100, 110 are compressed, and the panel 30 may be guided along the tracks 80, 85 in an upward, followed by an inward, motion. A worker skilled in the relevant art would be familiar with a track in the side rail 52 allowing for the movement of the first panel 30.

Figure 6:
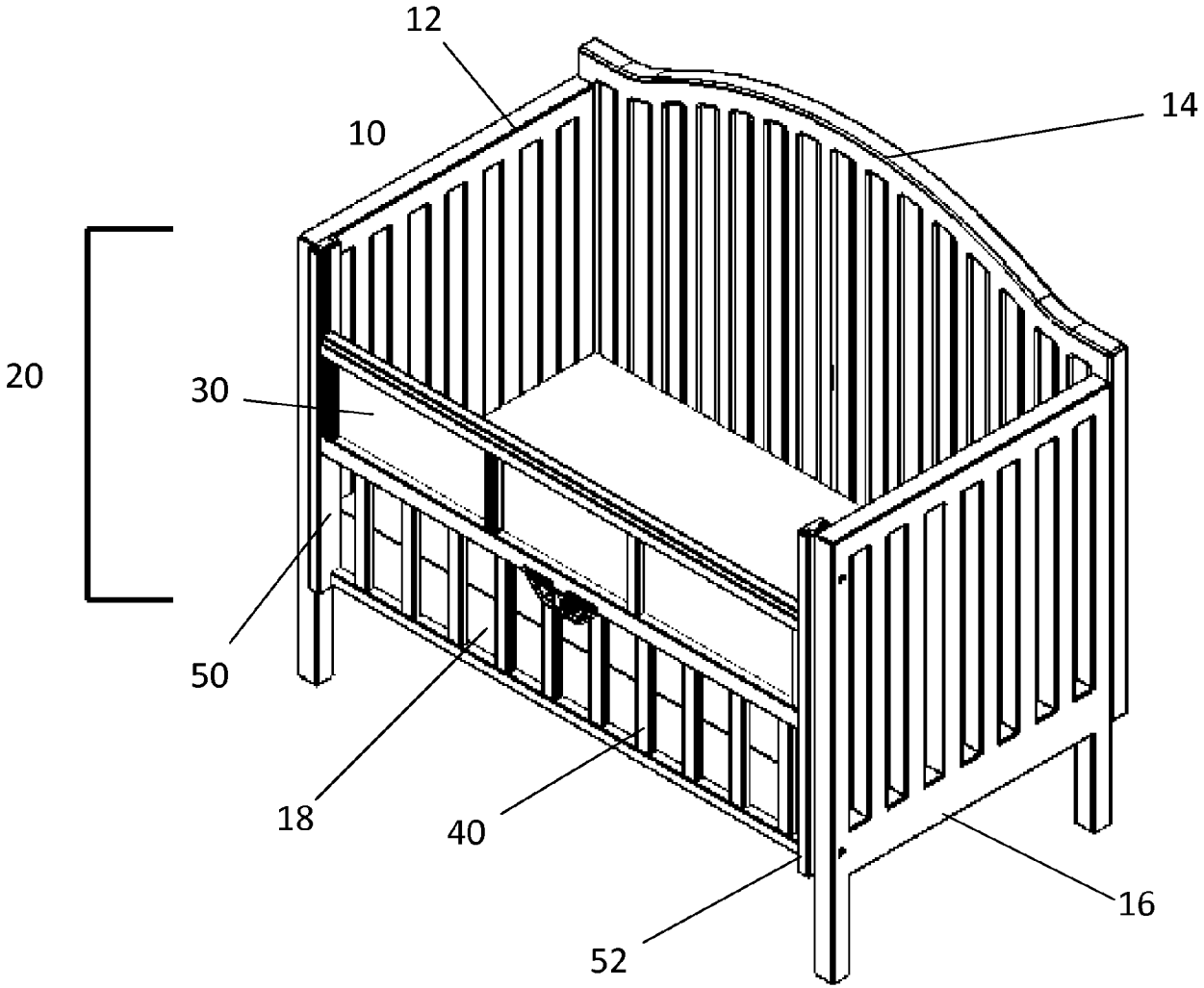
FIG. 6 is a perspective view illustrative of one embodiment of a panel assembly fastened to a crib.

With reference to FIG. 6, a further embodiment of a panel assembly 20 is shown. The panel assembly 20 is shown installed on a crib 10. The crib 10 comprises three fixed sides 12, 14 and 16, and a mattress support 18. The panel assembly 20 comprises of a first and second panel 30, 40 and first and second side rails 50, 52. The first panel 30 is slidable in an upward or downward motion along a single straight track, and is fastened to the track by a spring plunger.

In this embodiment, the first panel 30 may be comprised of either a metal, wooden, or plastic frame backed with a rigid plastic sheet that restricts toe holds and minimizes or even prevents entrapment of a child's limbs while allowing visibility within the crib. The second panel 40 may also be backed with a similar plastic material.

Figure 6A:
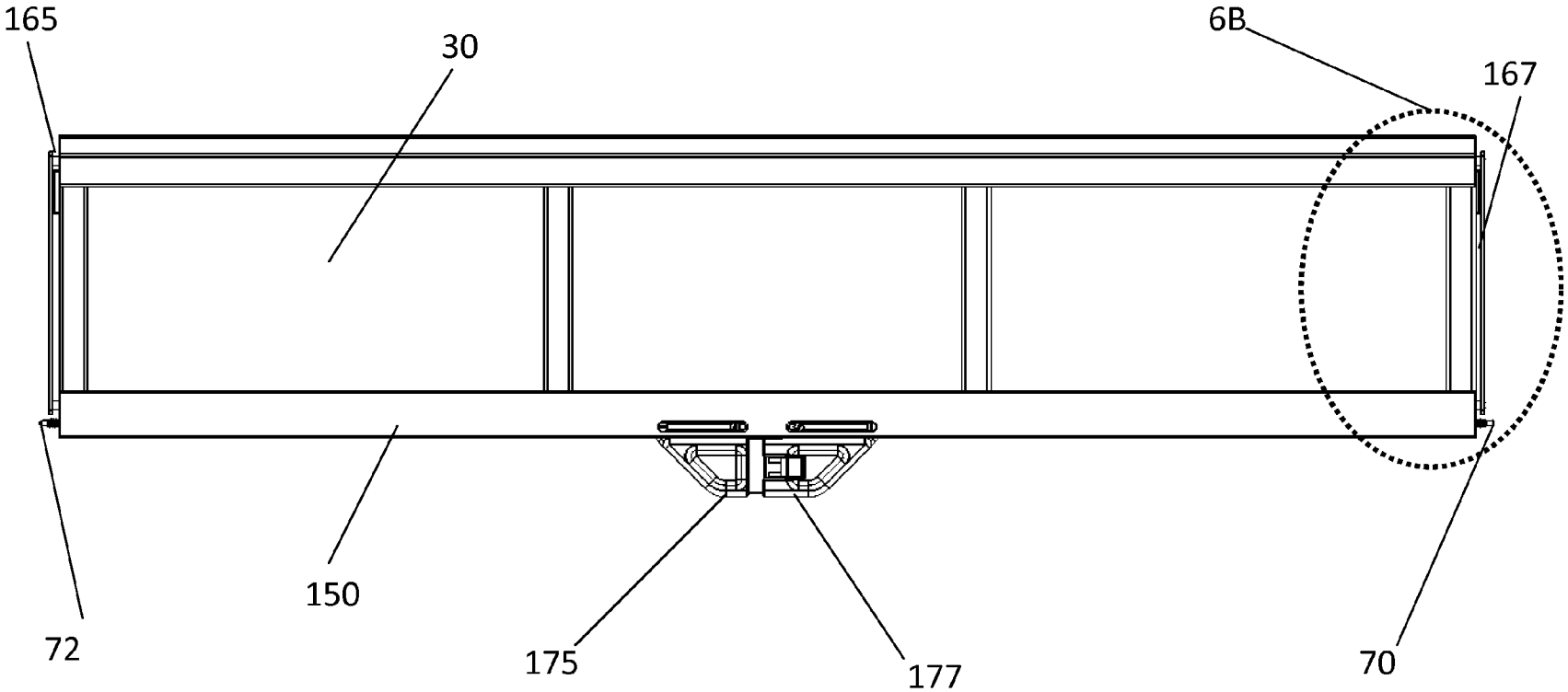
FIG. 6A is a front view illustrative of one embodiment of a first panel.

With reference to FIG. 6A, the first panel 30 is shown having a male handle 175 and a female handle 177. First panel 30 further comprises first and second spring plungers 72, 70 which are attached to male and female handles 175, 177 by means of first and second cables (not shown). A first sliding beam 165 is positioned at one end of the first panel 30 while a second sliding beam 167 is positioned at the opposite end of the first panel 30. The first panel 30 also has a hollow tube 150.

Figure 6B:
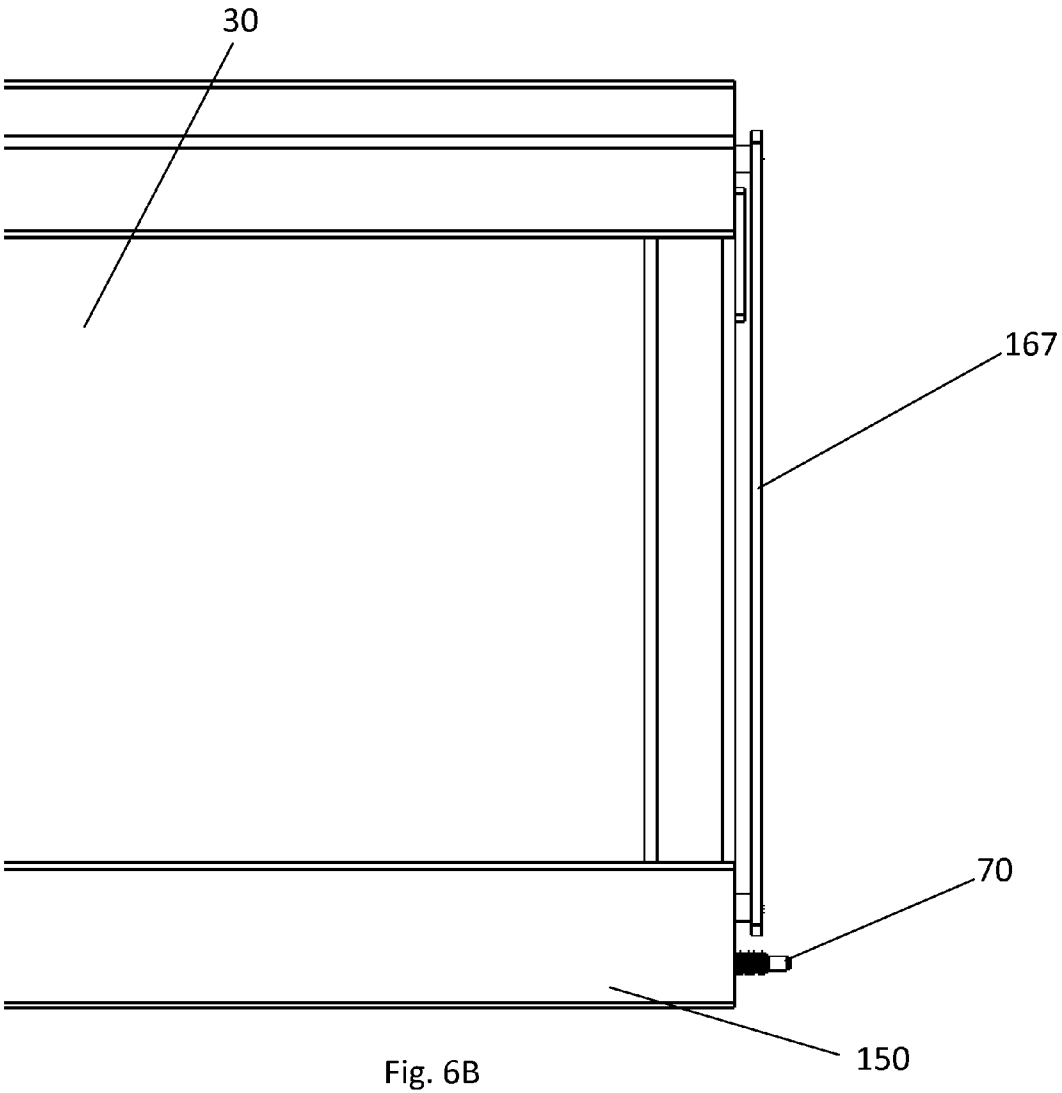
FIG. 6B is a front view illustrative of one embodiment of one end of a first panel.

With reference to FIG. 6B, the second sliding beam 167 and the second spring plunger 70 are shown in greater detail. The second sliding beam 167 is attached to the first panel 30 by means of screws or any other type of fastening device as would be appreciated by a worker skilled in the relevant art. The second sliding beam 167 is slideable within a single straight track in a side rail. This permits the first panel 30 to move in an upward or downward motion.

Figure 7:
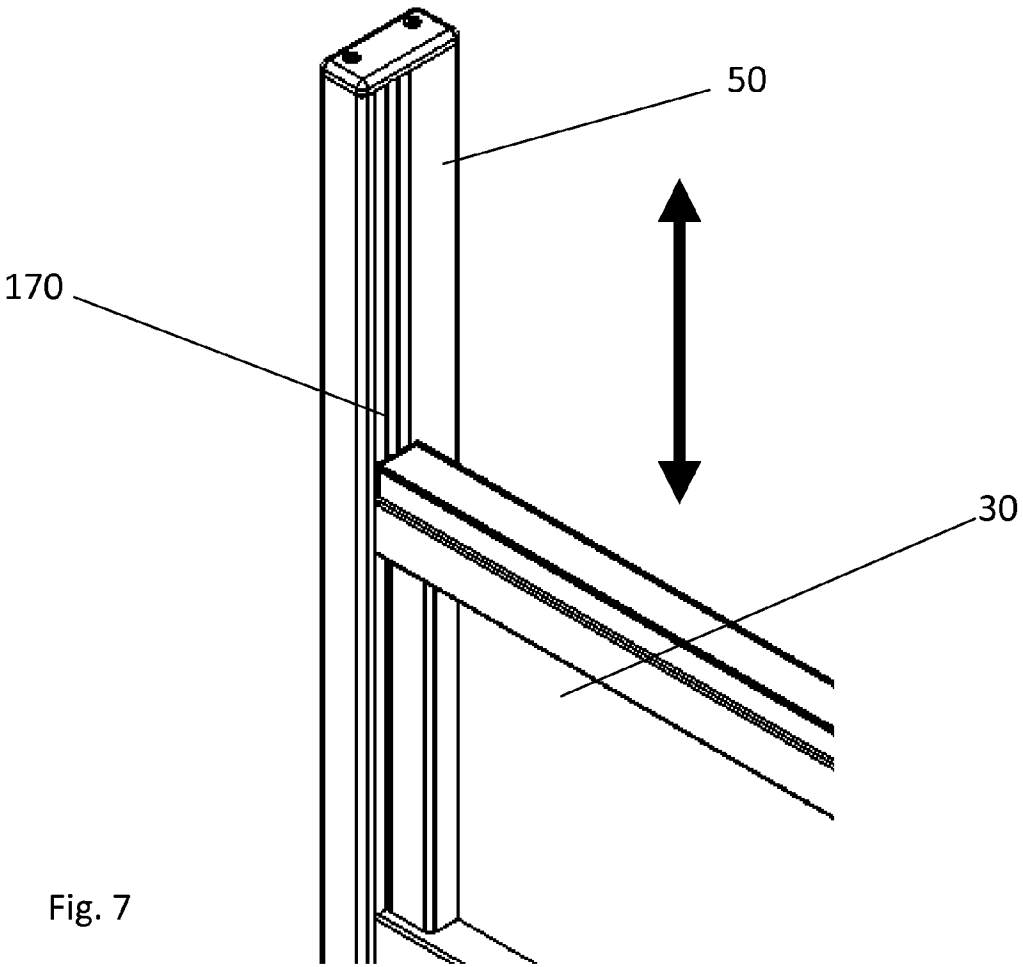
FIG. 7 is a perspective view illustrative of one embodiment of a first panel along a first side rail.

With reference to FIG. 7, the first panel 30 is positioned within a single straight track 170 of the first side rail 50. The single straight track 170 assures that the first panel 30 slides restrictedly in either an upward or downward motion.

Figure 8:
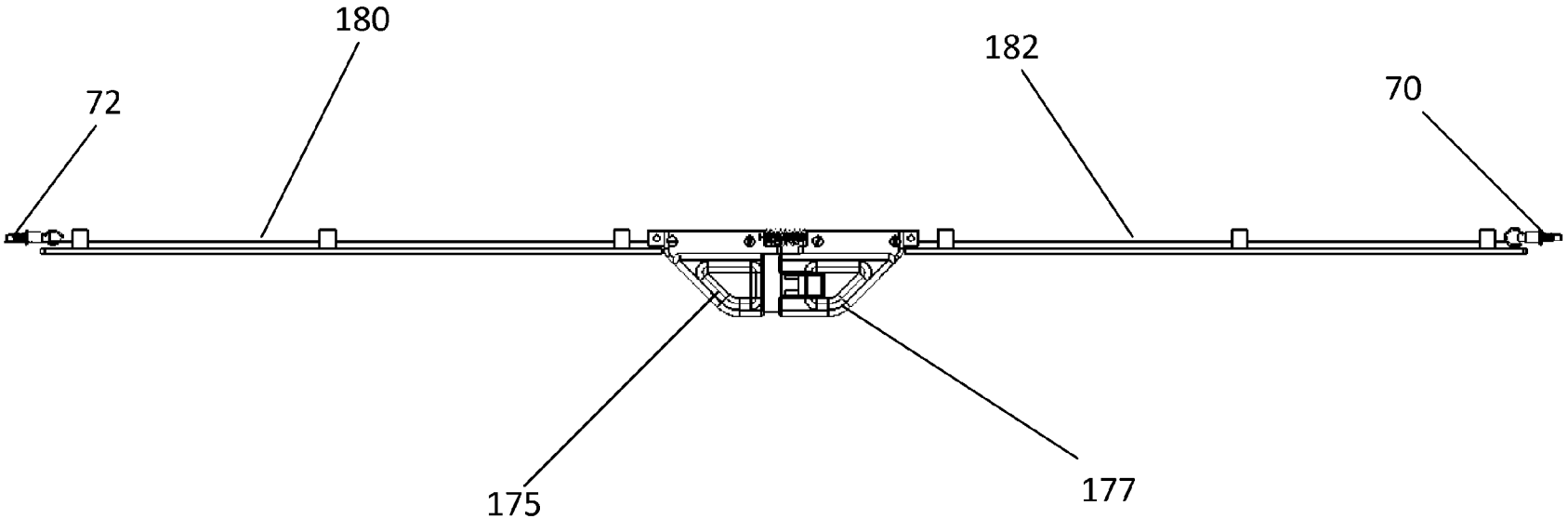
FIG. 8 is a front view illustrative of one embodiment of male and female locking mechanism handles attached to first and second cables.

With reference to FIG. 8, another locking mechanism installed within a panel assembly is shown. The locking mechanism comprises male and female handles 175, 177 and first and second cables 180, 182. The first and second cables 180, 182 may be enclosed within a hollow tube, with one end of the first cable 180 being attached to a first spring plunger 72, and one end of the second cable 182 being attached to a second spring plunger 70. The action of moving the male and female handles 175, 177 toward one another causes the corresponding first and second cables 180, 182 to pull the first and second spring plungers 72, 70. In turn, this releases the first panel, which can then be restrictedly slid either upward or downward.

Figure 9:
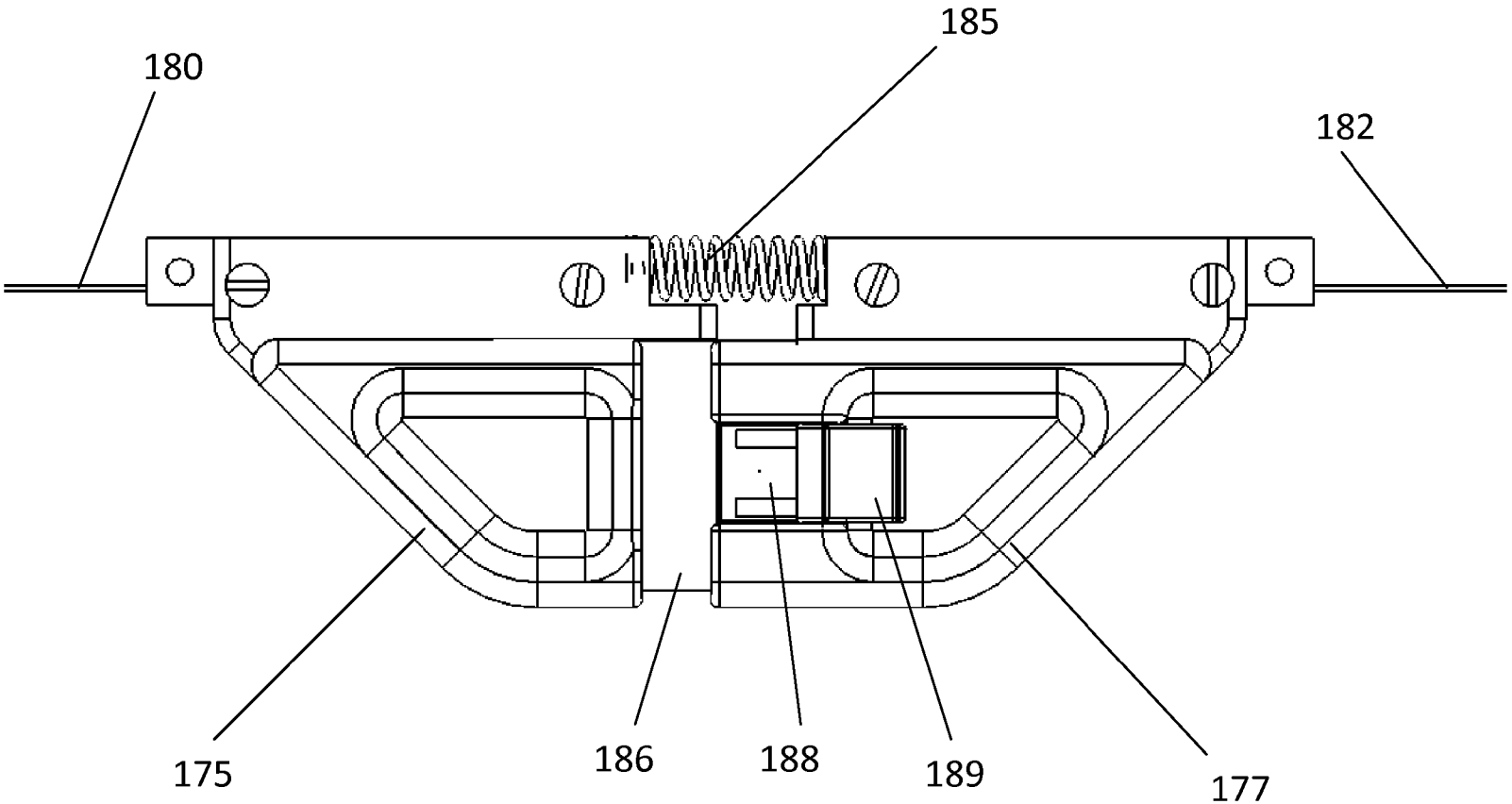
FIG. 9 is a front view illustrative of one embodiment of male and female locking mechanism handles.

With reference to FIG. 9, an in-depth view of one embodiment of the male and female handles 175, 177, respectively, is shown. A locking paddle 188 is pivotally connected to the female handle 177 and serves to restrict a protrusion 186 which forms part of the male handle 175 from being forced within the female handle 177. By pressing on the paddle actuator 189 and clenching the male and female handles 175, 177 toward one another, the locking paddle 188 pivots and the protrusion 186 is forced within the female handle 177. In turn, force is exerted onto the compression spring 185, and first and second cables 180, 182, respectively, are pulled accordingly.

Once fully clenched, the protrusion 186 of the male handle 175 is shifted completely within the female handle 177. As the male and female handles 175, 177 are released, the compression spring 185 pushes the male and female handles 175, 177 back to their original positions at rest and the locking paddle 188 locks back into place restricting the movement of protrusion 186.

Figure 10:
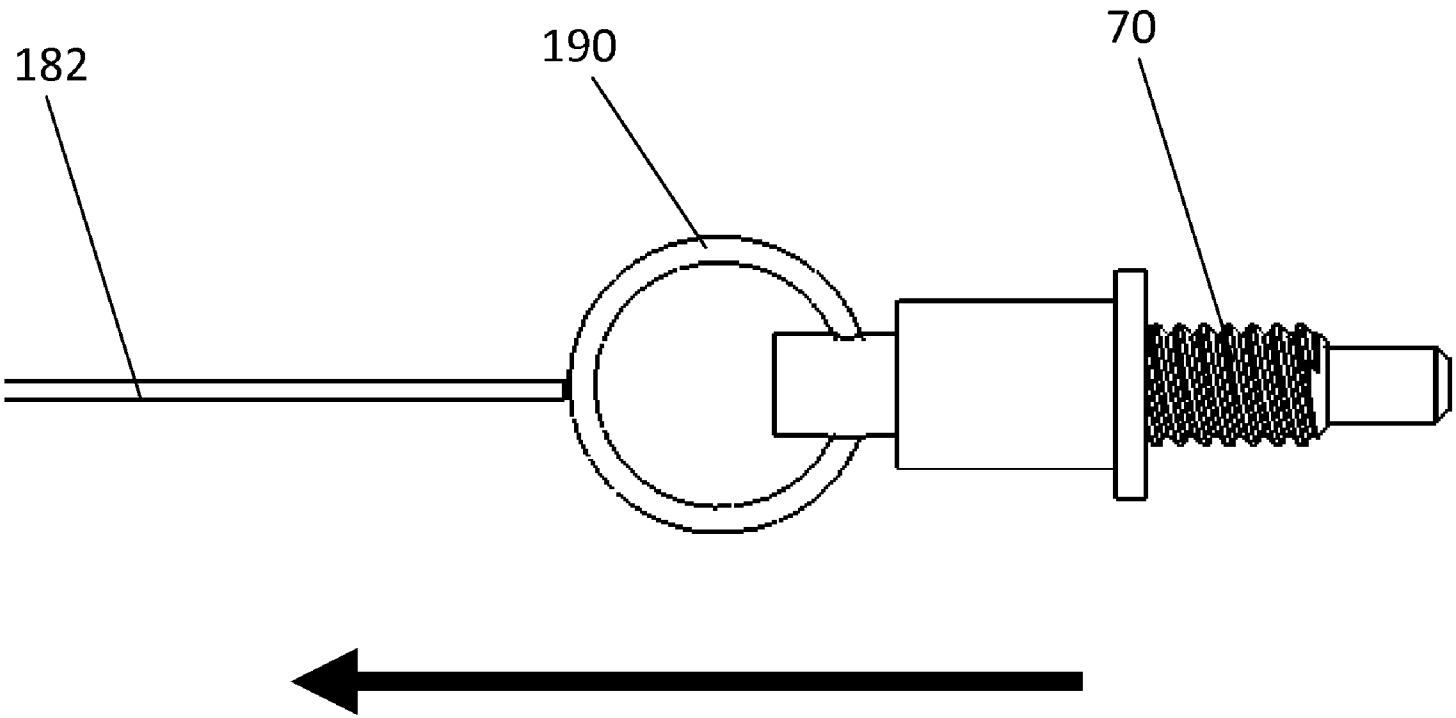
FIG. 10 is a front view illustrative of one embodiment of a second spring plunger attached to a second cable.

With reference to FIG. 10, the second cable 182 and the second spring plunger 70 are shown in greater detail. The second cable 182 is attached to the ring 190 of the second spring plunger 70. Pulling on the second cable 182 forces the spring within the second spring plunger 70 to compress, thereby sliding the second spring plunger 70 toward the second cable 182. The spring plunger may be a common device utilized in the art and may be replaced with any other similar spring as would be known to one skilled in the relevant art. It will be appreciated that a similar arrangement is used with the other cable.

Figure 11:
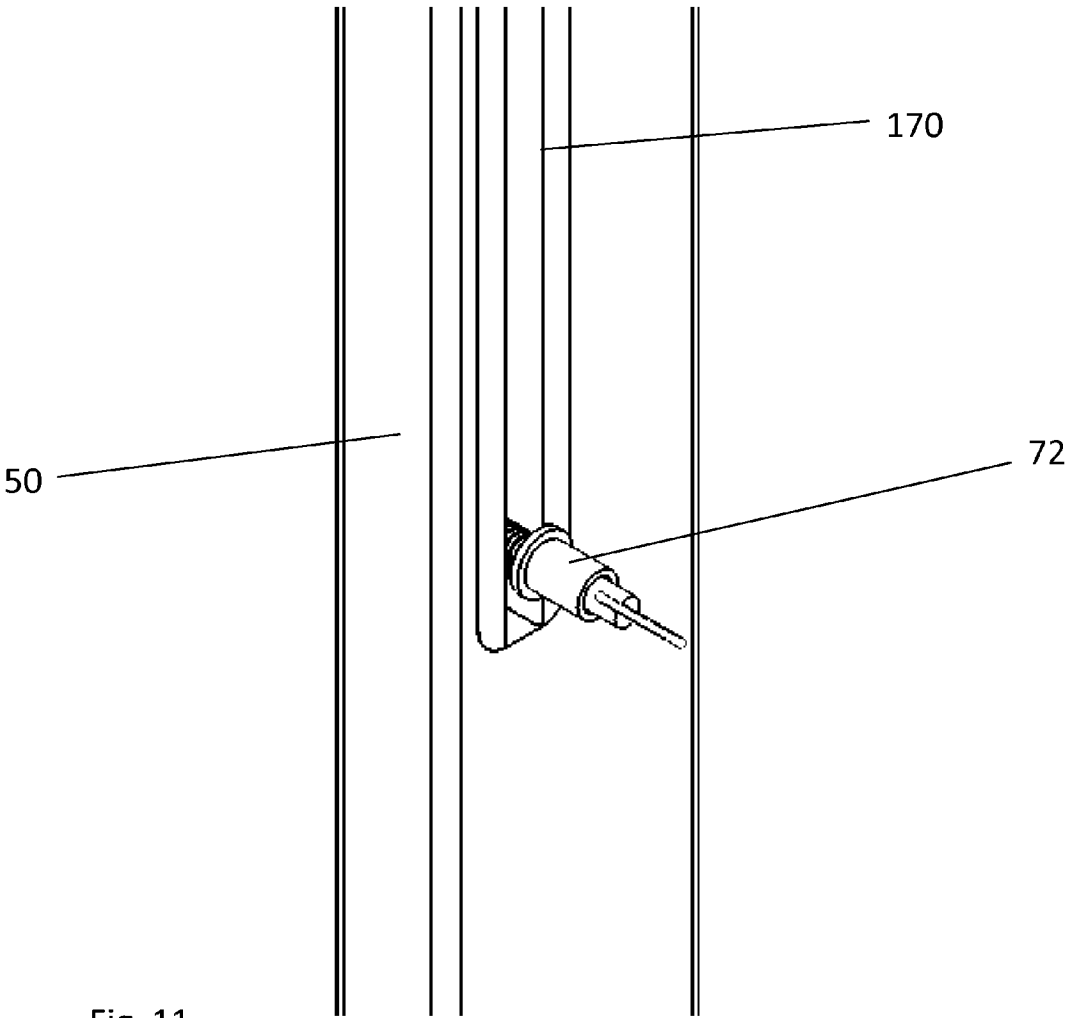
FIG. 11 is a perspective view illustrative of one embodiment of a first spring plunger within a single straight track of a first side rail.

With reference to FIG. 11, the first spring plunger 72 is shown within a single straight track 170 of the first side rail 50.

Figure 12:
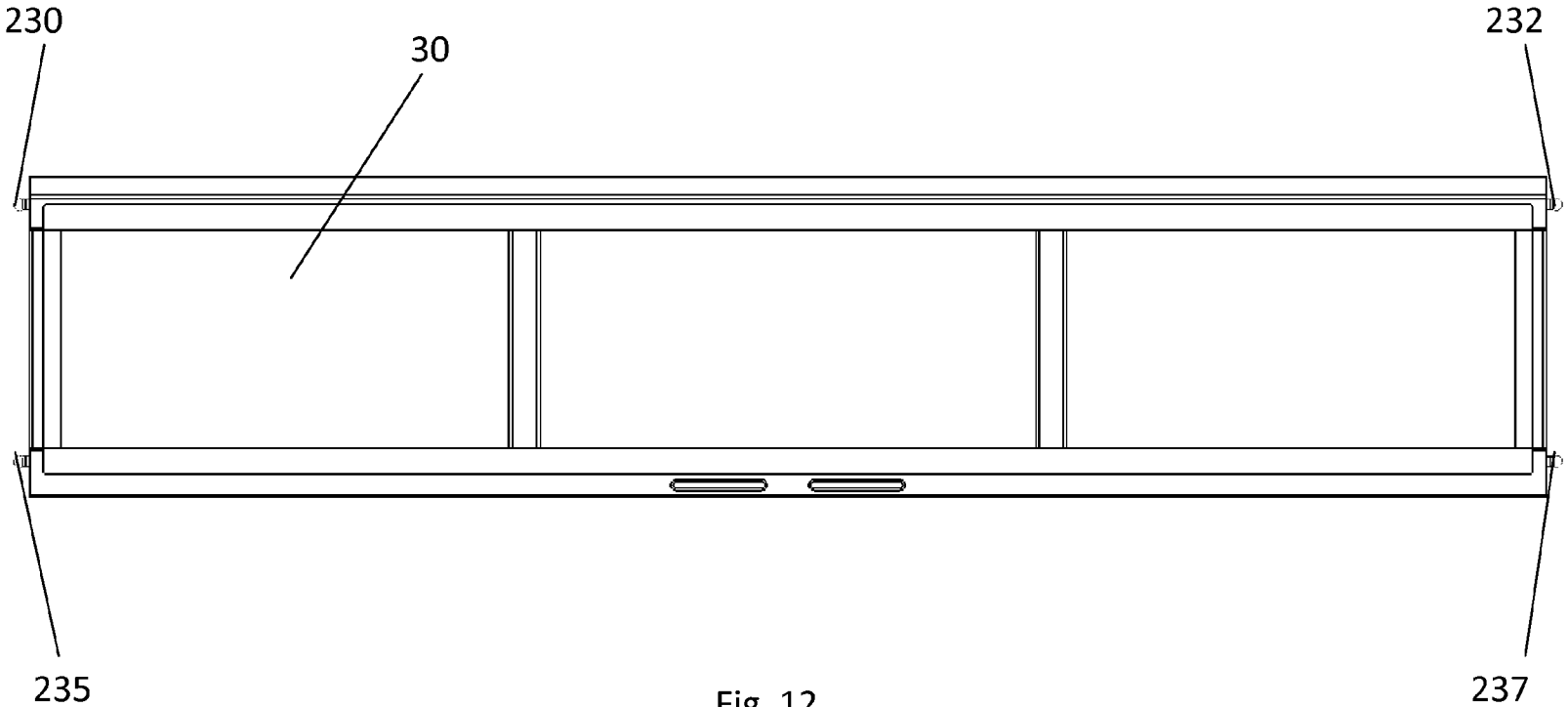
FIG. 12 is a front view illustrative of one embodiment of a first panel.

With reference to FIG. 12, another embodiment is shown. In the embodiment illustrated in FIG. 12, the first panel 30 is slideable along a track by means of upper mushroom-shaped protrusions 230, 232 and lower mushroom-shaped protrusions 235, 237. Male and female handles which actuate the spring plungers to lock the first panel 30 into place may be the same as those described with reference to previous embodiments.

Figure 13:
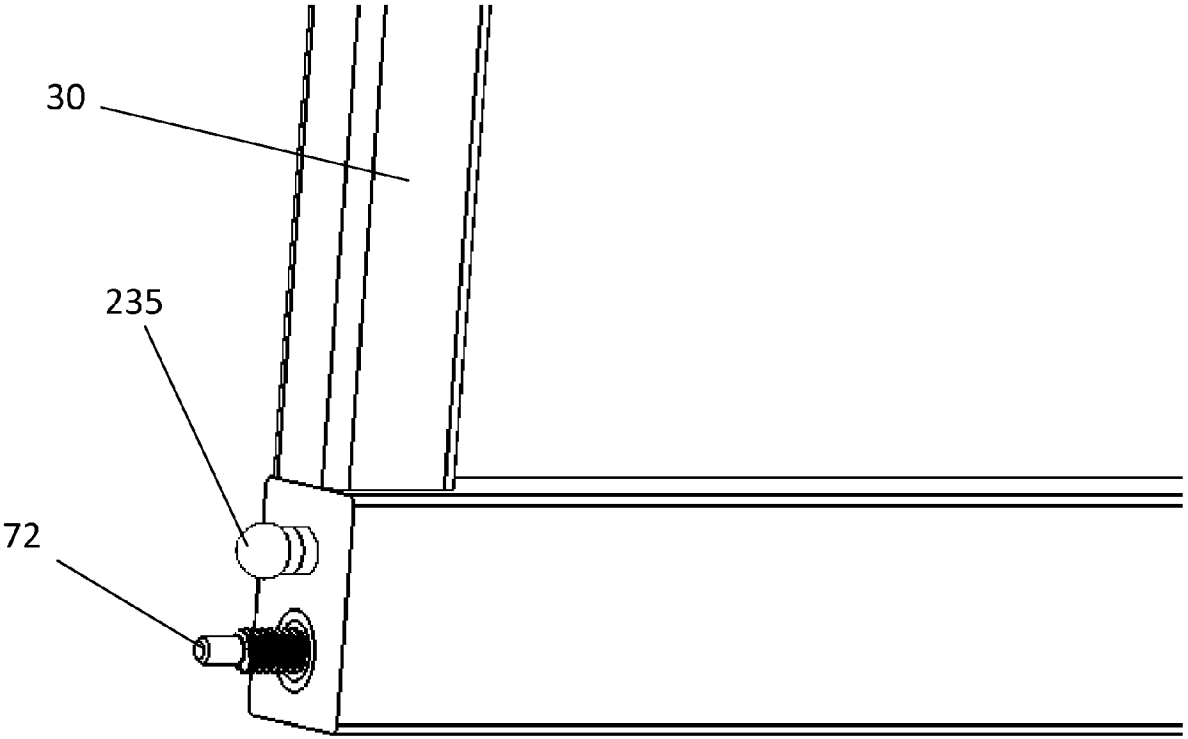
FIG. 13 is a perspective view illustrative of one embodiment of a lower mushroom-shaped protrusion and a first spring plunger within a first panel.

With reference to FIG. 13, a section of the first panel 30 is shown. The lower mushroom-shaped protrusion 235 is shown seen secured within the first panel 30, and the first spring plunger 72 is shown which serves to lock the first panel 30 into an upper or lower position.

Figure 14:
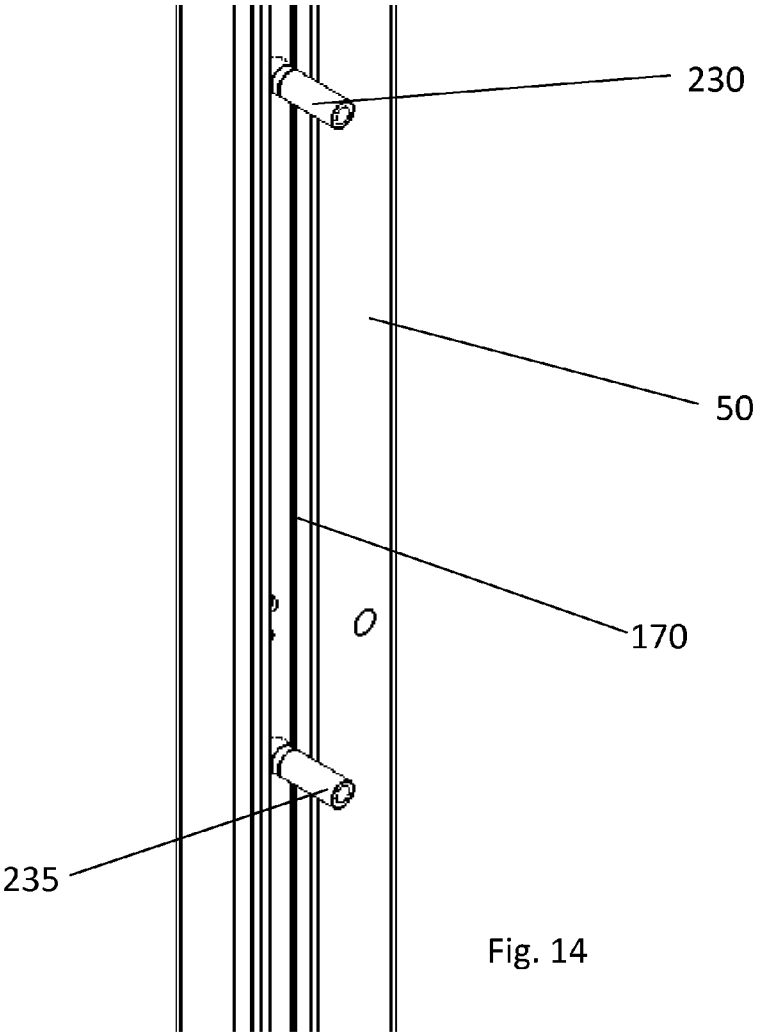
FIG. 14 is a perspective view illustrative of one embodiment of upper and lower mushroom shaped protrusions along a single straight track of a first side rail.

With reference to FIG. 14, the upper and lower mushroom-shaped protrusions 230, 235 can be seen locked into place within a single straight track 170. The single straight track 170 is within a first side rail 50. The single straight track 170 serves to restrictedly slide the upper and lower mushroom-shaped protrusions 230, 235 up or down.

Figure 15:
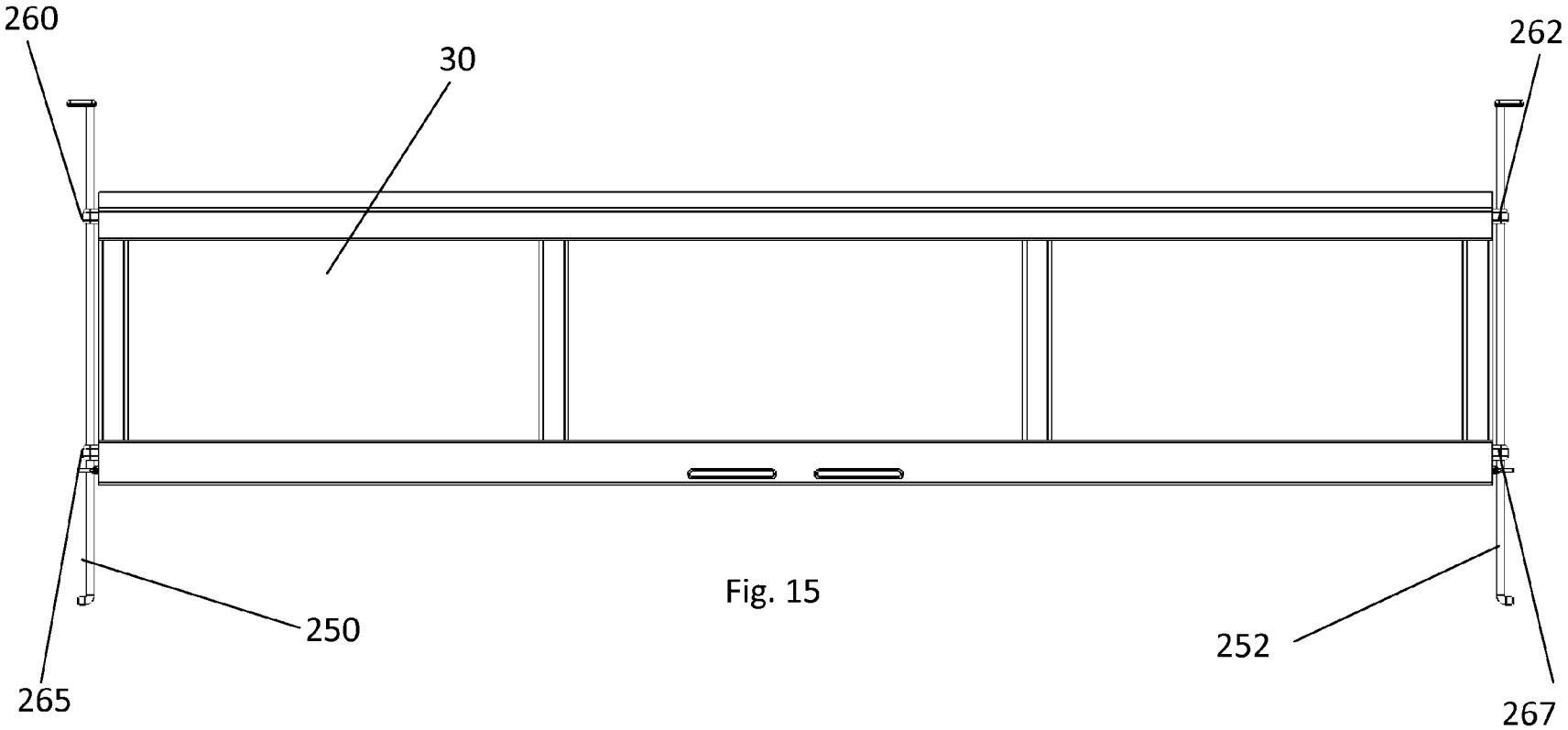
FIG. 15 is a front view illustrative of one embodiment of a first panel.

With reference to FIG. 15, another embodiment is shown. In this embodiment, a first sliding rod 250 is fastened to one end of the first panel 30 by upper and lower pins 260, 265 while a second sliding rod 252 is fastened to the opposite end of the first panel 30 by upper and lower pins 262, 267.

Figure 16:
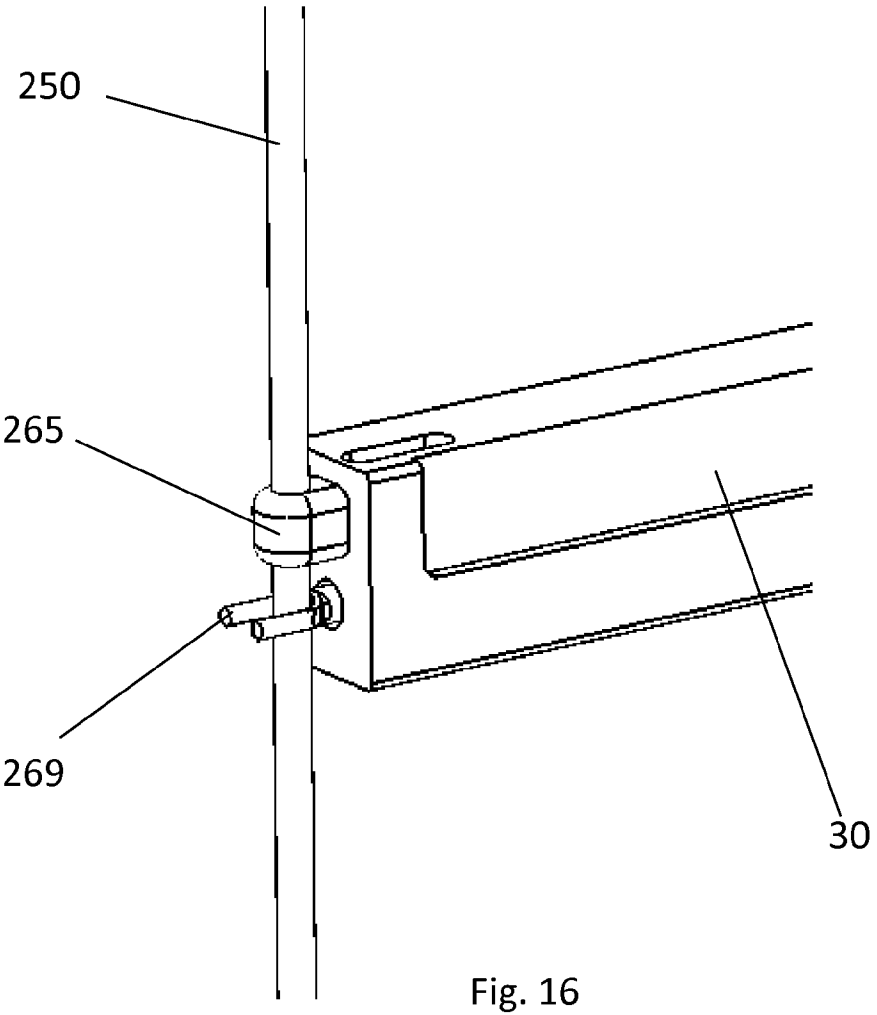
FIG. 16 is a perspective view illustrative of one embodiment of a first horseshoe plunger and first pin within a first panel.

With reference to FIG. 16, a section of the first panel 30 is shown. The lower pin 265 is shown with one end fastened to the first panel 30 and the opposite end wrapped around the first sliding rod 250, such that the first panel 30 can slide up and down the first sliding rod 250. In the present embodiment, the first spring plunger is replaced by a first horseshoe plunger 269. The first horseshoe plunger 269 locks into either upper or lower lock apertures 200, 202 of a cavity 270 (shown in FIG. 18) of the first side rail 50.

Figure 17:
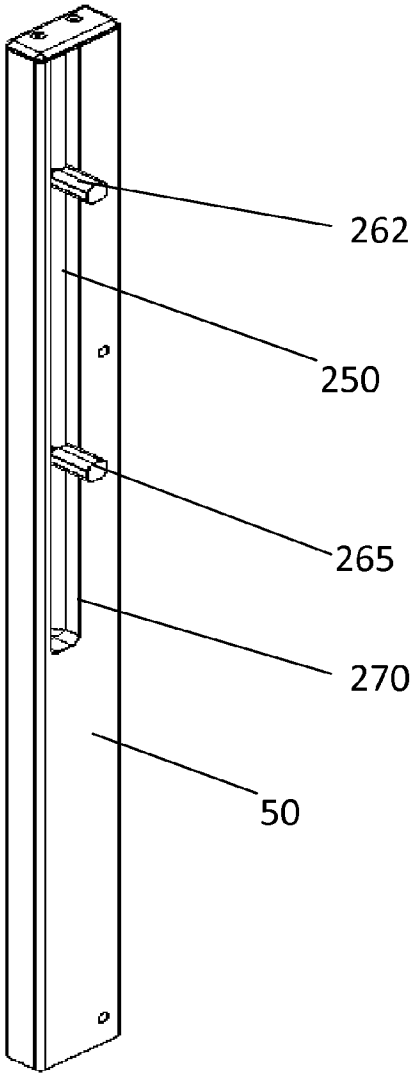
FIG. 17 is a perspective view illustrative of one embodiment of a first sliding beam within a cavity of a first side rail.

With reference to FIG. 17, the first sliding rod 250 is shown within a cavity 270 of the first side rail 50. Upper and lower pins 262, 265 may be seen attached to the first sliding rod 250 in order to slide upward or downward along its axis.

Figure 18:
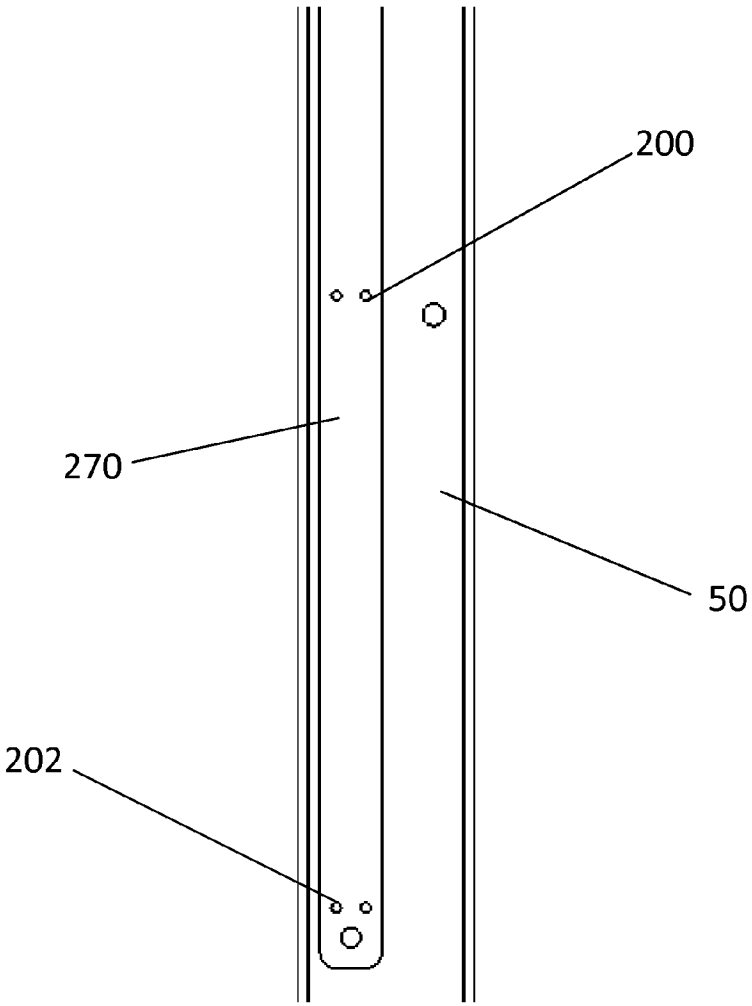
FIG. 18 is a side view illustrative of one embodiment of a cavity within a first side rail.

With reference to FIG. 18, the cavity 270 is shown within the first side rail 50. Upper and lower lock apertures 200, 202, which conform to the shape of the horseshoe plunger 269 (shown in FIG. 16), are utilized in order to lock into place the first panel 30 in either an upper or lower position.

Many modifications of the embodiments described herein as well as other embodiments may be evident to a person skilled in the art having the benefit of the teachings presented in the foregoing description and associated drawings. It is understood that these modifications and additional embodiments are captured within the scope of the contemplated invention which is not to be limited to the specific embodiment disclosed.

I claim:

1. A panel assembly for a crib having four posts and a mattress, the assembly comprising:

a. a first and second side rail each having at least one guide;

b. a first panel having two sides an upper edge and a lower edge; and c. a second panel fixed to the first and second side rails and extending predominantly above said mattress to form a wall of said crib along with said first panel, wherein the first panel is translatable substantially linearly and vertically within said guides of first and second side rails, said guides disposed and shaped to minimize a distance between said first panel and said second panel, the panel assembly further comprising a locking mechanism for locking the first panel in a predetermined position, wherein the locking mechanism is associated with the first panel and comprises a pair of handles and two retractable plungers disposed each at the respective side of the first panel for retractable engagement with the respective side rail, said handles being operative to retract said plungers from engagement with said side rails to move said first panel.

2. The panel assembly according to claim 1 wherein said pair of handles is disposed substantially at the lower edge of the first panel.

3. The panel assembly according to claim 1 wherein said plungers are horseshoe plungers.

4. The panel assembly according to claim 3 wherein said plungers are disposed substantially at the lower edge of the first panel.

5. The panel assembly according to claim 1 wherein said plungers are disposed substantially at the lower edge of the first panel.

6. A panel assembly for a crib having four posts and a mattress, the assembly comprising:

a. a first and second side rail each having at least one guide;

b. a first panel having two sides, an upper edge and a lower edge; and c. a second panel fixed to the first and second side rails and extending predominantly above said mattress to form a wall of said crib along with said first panel, wherein the first panel is translatable linearly and substantially vertically within said guides of first and second side rails, said first panel having protrusions at the top and bottom of each side thereof, the protrusions engaging the guides for translation of the first panel, and a locking mechanism for locking the first panel in a predetermined position, the locking mechanism disposed at the lower edge of the first panel.

7. The panel assembly according to claim 6 wherein the locking mechanism comprises two handles, two spring plungers disposed each at the respective side of the first panel for retractable engagement with the respective side rail, said handles being operative to retract said plungers from engagement with said side rails to move said first panel.

* * * * *